United States Patent [19]

Proutt

[11] Patent Number: 4,662,415

[45] Date of Patent: May 5, 1987

[54] COVER FOR A GOLF CLUB HANDLE

[76] Inventor: Gordon R. Proutt, 8-275 Midwinter Avenue, Winnipeg, Manitoba, Canada, R2L 0V1

[21] Appl. No.: 847,310

[22] Filed: Apr. 2, 1986

[51] Int. Cl.[4] ..... A63B 53/14; A63B 57/00

[52] U.S. Cl. ..... 150/52 G; 150/52 R; 16/DIG. 12; 273/32 R; 273/81 R; 273/162; 273/165

[58] Field of Search ..... 150/52 R, 52 G, 52 L; 206/315.2, 315.4; 16/116 R, DIG. 12; 74/551.8, 551.9, 558.5; 273/81 R, 81 D, 162, 165, 32 R, 32 E

[56] References Cited

U.S. PATENT DOCUMENTS

| | | | |
|---|---|---|---|
| 574,755 | 1/1897 | Oehler | 74/558.5 X |
| 1,162,896 | 12/1915 | Achberger | 16/DIG. 12 X |
| 1,617,972 | 2/1927 | Wallace | 273/81 R X |
| 1,890,037 | 12/1932 | Johnson | 273/81 R |
| 1,942,922 | 1/1934 | Gerow | 273/165 |
| 2,128,546 | 8/1938 | Venmore | 150/52 G X |
| 2,459,996 | 1/1949 | Duncan, Jr. | 273/81 R |
| 3,147,012 | 9/1964 | Sullivan, Jr. | 273/165 |
| 3,397,891 | 8/1968 | Koch | 273/165 X |
| 3,606,326 | 9/1971 | Sparks et al. | 273/81 R |
| 3,860,243 | 1/1975 | Prisco, Sr. | 273/81 D X |

FOREIGN PATENT DOCUMENTS

| | | | |
|---|---|---|---|
| 14535 | of 1908 | United Kingdom | 74/551.9 |
| 535324 | 4/1941 | United Kingdom | 273/81 R |

*Primary Examiner*—William Price
*Assistant Examiner*—Sue A. Weaver
*Attorney, Agent, or Firm*—Stanley G. Ade; Adrian D. Battison

[57] ABSTRACT

A cover for a golf club handle comprises an end section for receiving the widest end of the tapered handle and a tapered section for closely surrounding the tapered handle with an opening flap provided in the tapered section whereby the handle can be inserted into the end section and the flap closed to fully surround the handle. The cover comprises an outer sheath of water resistant plastic material which may be either flexible or rigid and an inner layer of a water absorbent material. A further embodiment comprises a rigid tube which has a closure cap at the open end hingedly attached to the tube to allow the handle to slide into the tube.

10 Claims, 8 Drawing Figures

11
20
21
16
21
21
18
13
21
15
12
10
14
5
5

19
16
15
18
21

17
18
21
19
16
15
21

11
20
21
18
16
10
21
15
14
6
6

COVER FOR A GOLF CLUB HANDLE

BACKGROUND OF THE INVENTION

This invention relates to a cover for a golf club handle.

Generally, golf clubs are inserted into a golf bag with the handles presented downwardly either freely into the bag or in most cases into a set of tubes in the base of the bag. The exposed club head is then in some cases covered by a simple plastic sheath which is pulled over the head from the free end and extends over the head down towards the shaft of the club. The sheath is a simple flexible plastic material which can, in some cases, be elasticated adjacent the open end for retaining the sheath on the head.

However, when the club is removed from the bag and even while the club is in the bag it is accessible to rain and other moisture which can collect on the handle. as is well known, the golfer's grip on the handle is of paramount importance, with any slippage between the hands of the golfer and the handle at least interfering with the proper shot and in some cases causing dangerous release of the club.

SUMMARY OF THE INVENTION

It is one object of the present invention therefore to provide a novel and improved structure of cover for the handle of a golf club.

Accordingly, the invention provides a removable cover for a handle of a golf club of the type in which a generally cylindrical handle extends axially from a shaft of the club, the cover comprising a generally tubular member shaped to closely surround the handle, an end cap portion closing one end of the tubular member, hinged closing means arranged on said tubular member such that, in an open condition of the closing means, the tubular member can be slid onto said handle to surround the handle with the end cap portion adjacent an end of the handle, and such that, in a closed condition of the closing means, the cover encloses the handle, seal means for closely surrounding the shaft in the closed condition, and moisture absorbent means on the interior of the cover at least adjacent the seal means.

It is one advantage of the invention therefore that the cover can closely surround and closely follow the contour of the handle to provide a neat and attractive appearance and to provide the minimum bulk around the handle.

It is a further advantage of the invention that the inside surface of the cover is coated with a resilient layer of water or moisture absorbent material so that when a wet handle is replaced in the cover, the handle is dried for use on the next occasion during the round of golf.

It is a yet further advantage of the invention that the hinged or door section of the tapered portion allows the cover to be readily and quickly applied to the handle and removed therefrom for use of the club and thus minimizes the contact of the handle with any falling rain.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figures 1, 2, 5, 6:
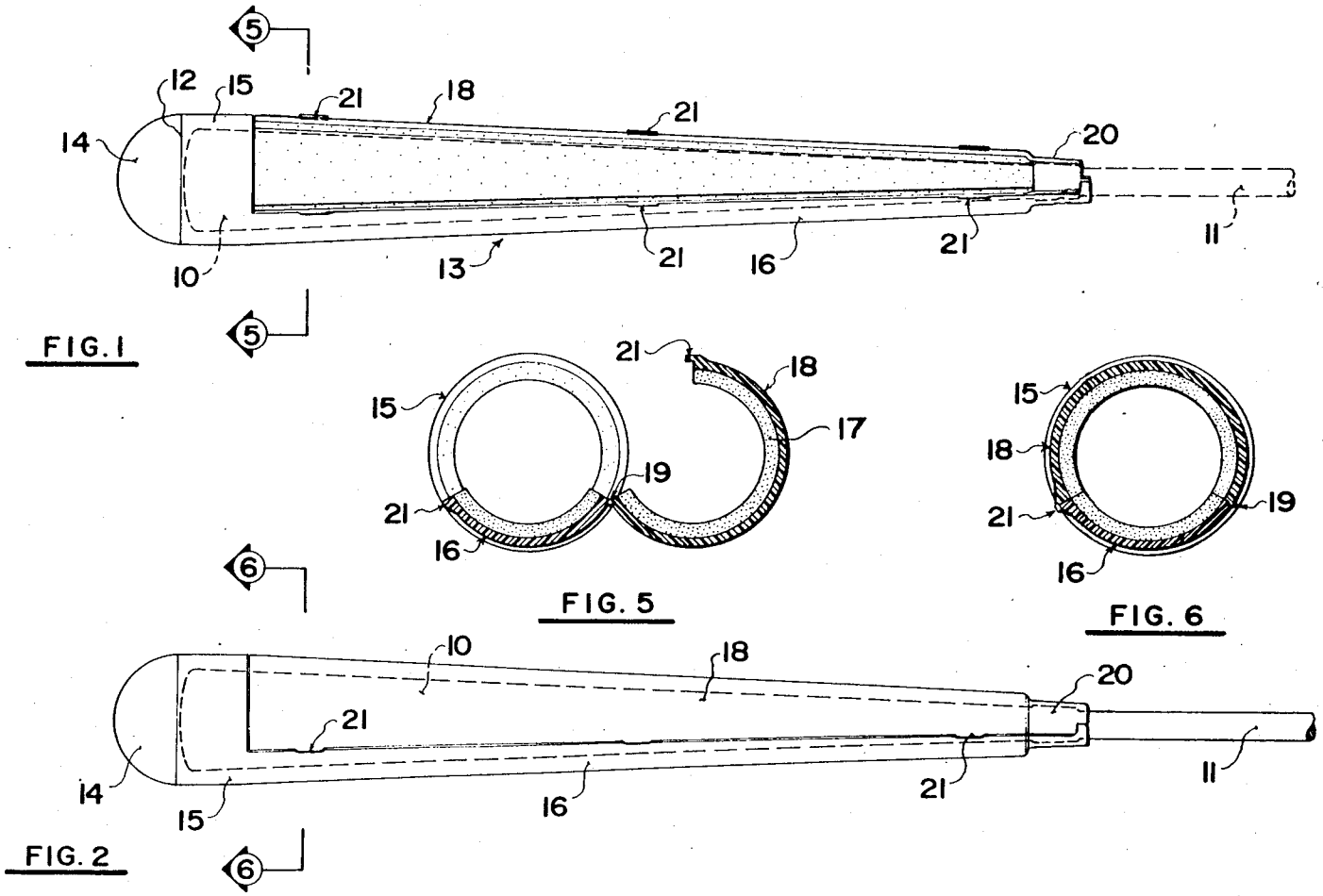
FIG. 1 is a side elevational view of a first embodiment of the handle cover showing the club handle in phantom and with the hinged section open.
FIG. 2 is a similar side elevational view showing the hinged section closed.
FIGS. 5 and 6 are cross sectional views along the lines 5—5 and 6—6 respectively.

A golf club handle is illustrated in FIG. 1 in phantom and as is well known, it comprises a gradually tapering conical member reducing in diameter from a remote end toward a shaft of the club generally indicated at 11. The handle is generally indicated at 10 and includes a remote or widest end 12.

Figure 4:
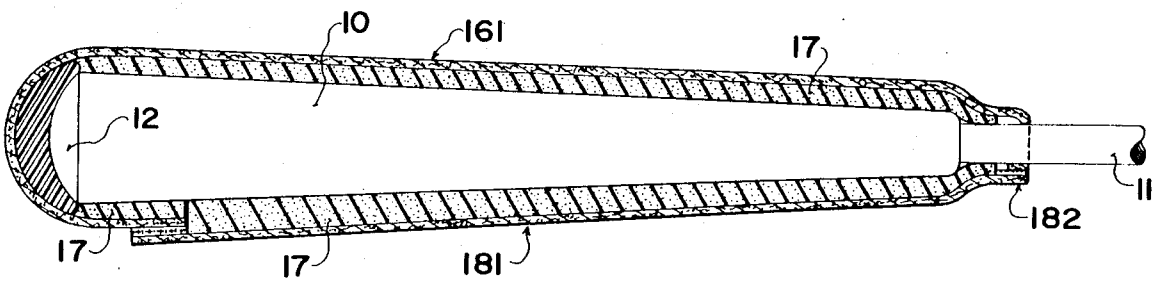
FIG. 4 is a cross sectional view along the lines 4—4 of FIG. 3.

A cover for the handle is generally indicated at 13 and comprises an end cap 14, a first cylindrical portion 15 and a second tapered portion 16. The cylindrical portion 15 and the tapered portion 16 are both formed from a substantially rigid plastic material and are both coated wholly on the inside by a fibrous resilient layer of moisture absorbent material such as towelling or a non-woven cotton lint type material which is attached to the plastic cover suitably by adhesives. The absorbent material is shown in better detail in FIG. 4 where it is indicated at 17.

The tapered section 16 includes a hinged portion or door 18 which is formed from the same substantially rigid plastic material and which is hinged to the body of the section 16 by a plurality of hinges 19 which are sprung so as to provide two stable positions for the hinged door 18, that is an open position and a closed position with the sprung movement therebetween thus the door 18 remains in stable condition in the open position shown in FIG. 1 and also in the closed position shown in FIG. 2.

In the open position the handle end can be inserted through the opening between the tapered section 16 and the cylindrical section 15, into the cylindrical section 15 where it slides toward the closed end of the cover defined by the end cap 14. The cylindrical section 15 can, in fact, be slightly tapered inwardly with the squeezing of the resilient absorbent layer 17 at the opening allowing the widest end of the handle to pass into the cylindrical section.

When positioned with the end of the handle in the cylindrical section 15, the remainder of the handle can be laid in the lower section of the tapered portion 16 and the hinged section closed over the remainder of the handle to fully enclose the handle as shown in FIG. 2.

It will be noted that the end of the tapered section 16 includes a turned-down portion 20 which is positioned adjacent the point where the handle terminates so that the portion 20 is tightly fitted around the shaft 11 of the club. Thus, in the closed positioned shown in FIG. 2, the handle is fully enclosed or contained within the cover and at all points on the handle, the resilient absorbent material is pressed into contract with the handle by the rigid plastic cover. To ensure that the hinged section 18 remains closed, a plurality of clips 21 can be provided along the edge thereof for engagement with corresponding clip portions provided on the edge of the fixed section of the tapered portion 16.

Figure 3:
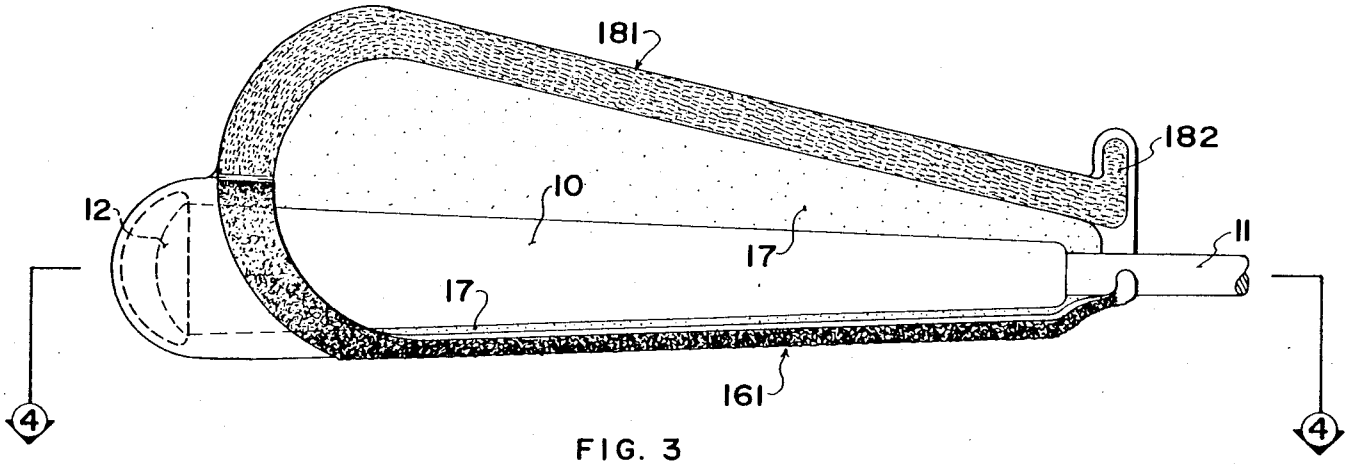
FIG. 3 is a view similar to that of FIG. 1 of a second embodiment of the cover.

Turning now to FIG. 3, this embodiment is modified in that the plastic outer cover is formed of a more flexible material so the hinged door 181 of the tapered section 161 can be merely contiguous with the fixed section of the tapered portion 161. In this way, the closing of the hinged section is obtained merely by wrapping the tapered portion around the handle. The sealing of the hinged section 181 to the stationary section can be obtained by any suitable means, for example, hooked and looped interconnecting fabric which is well known as a readily releasable connecting technique. Also, the use of this material allows a tail 182 at the end of the tapered section adjacent the shaft to be wrapped rightly around the shaft to provide a seal to prevent moisture running down the shaft to the handle.

The end cap 14 can be formed of a resilient material such as rubber, to provide a protective end for the handle.

Figure 7:
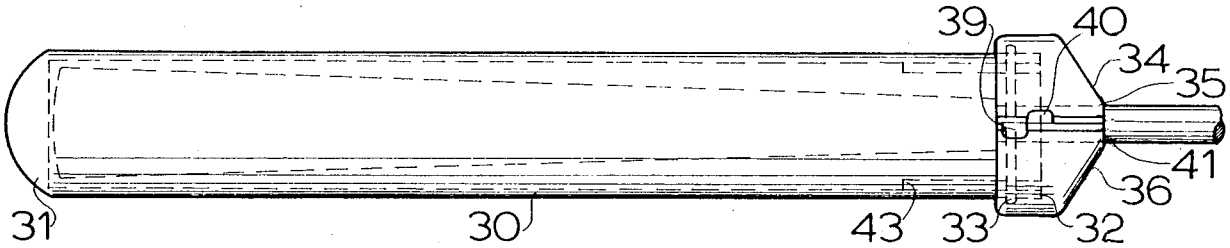
FIG. 7 is a side elevational view of a further embodiment of the cover.

Turning now to FIG. 7, the cover comprises a circular cylindrical, tubular member 30 which has a closed end cap 31 with a domed exterior surface. The tubular member 30 is formed of a rigid material and has an open end 32 remote from the end cap 31 providing an open circular mouth through which the handle can be inserted. A rib 33 is positioned about the tube adjacent the open end for cooperation with an end cap 34 which acts to close the open end 32.

The end cap 34 comprises two halves 35 and 36 which are hinged about a line 37 and are attached to the tubular member at the line 37 by a suitable mechanism 38.

Figure 8:
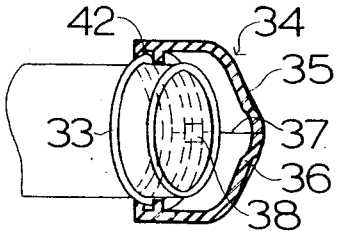
FIG. 8 is a part cross sectional view of the open end of the cover of FIG. 7.

On the side of the end cap 34 remote from the hinge line 37 is provided a pair of spring snaps 39 of conventional type which overlap to snap the end cap 34 into a closed position as illustrated in FIG. 7. In that closed position, a soft plastics portion 41 of the end cap closely surrounds the shaft to act as a seal against the shaft to prevent moisture from entering. The end cap 34 includes a recess 42 for cooperation with the rib 33 a best shown in FIG. 8 so that when it is in the closed position it clamps around the tube at the rib 33 to be retained in position on the tubular portion.

It will be appreciated that the snaps 39, 40 can be actuated to open the end cap, which then remains attached to the tubular member at 38 whereupon the tubular member can be slid off the handle to release the handle and the shaft for use.

A moisture absorbent material 43 is positioned inside the tubular portion at the open end to assist in removing moisture from the handle should any collect on the handle and for collecting any moisture which may pass the seals provided by the sealing rim 41 and the labyrinth provided by the recess 42 and the rib 33.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A removable cover for a handle of a golf club of the type in which a generally cylindrical handle extends axially from a shaft of the club, the cover comprising a generally tubular member shaped to closely surround the handle, an end cap portion closing one end of the tubular member, hinged closing means arranged on said tubular member such that, in an open condition of the closing means, the tubular member can be slid onto said handle to surround the handle with the end cap portion adjacent an end of the handle, and such that, in a closed condition of the closing means, the cover encloses the handle, seal means for closely surrounding the shaft in the closed condition, and moisture absorbent means on the interior of the cover at least adjacent the seal means.

2. The invention according to claim 1 wherein the tubular member is formed from a water resistent, material.

3. The invention according to claim 1 wherein said end cap portion includes a domed exterior surface and is formed of a resilient material.

4. The invention according to claim 1 wherein the tubular member is substantially rigid.

5. The invention according to claim 1 wherein said seal means comprises a soft plastics rim portion for closely surrounding the shaft.

6. The invention according to claim 1 wherein said tubular member forms an elongate tapered portion for receiving the handle, the elongate tapered portion having one section thereof extending along its full length which can be opened at a pivot axis lying generally longitudinally of the handle and forming said closing means whereby said tapered portion can be placed onto said handle and said section pivoted about said axis to confine said handle, said seal means being provided by an end of said pivotal section and said tapered portion at said shaft which is wrapped around said shaft in a tight press fit.

7. The invention according to claim 6 wherein the opening section of the tapered portion is of the order of half of the tapered portion divided longitudinally thereof.

8. The invention according to claim 6 wherein the opening section includes means mounting the section on the tapered portion providing two stable positions at the open and closed positions thereof with spring movement therebetween.

9. The invention according to claim 6 wherein the opening section includes readily releasable fastener means for holding the opening section in a closed position relative to the tapered portion.

10. The invention according to claim 1 wherein said tubular member is circular cylindrical having a diameter substantially equal to a diameter of the handle at the end thereof remote from the shaft, said tubular member being substantially closed and continuous to an open end thereof adjacent the end of the handle at the shaft and wherein said closing means comprises an end cap member hinged to said tubular member and comprising two portions for enclosing the shaft and closing said open end.

* * * * *